US007905203B2

(12) United States Patent
Tawarada et al.

(10) Patent No.: US 7,905,203 B2
(45) Date of Patent: Mar. 15, 2011

(54) OIL COOLER FOR VEHICLE

(75) Inventors: Yuichi Tawarada, Wako (JP); Masashi Furuya, Wako (JP); Yoshihiro Tajima, Kariya (JP)

(73) Assignees: Honda Motor Co., Ltd., Tokyo (JP); Denso Corporation, Kariya (JP)

( * ) Notice: Subject to any disclaimer, the term of this patent is extended or adjusted under 35 U.S.C. 154(b) by 284 days.

(21) Appl. No.: 12/228,252

(22) Filed: Aug. 11, 2008

(65) Prior Publication Data

US 2009/0056650 A1 Mar. 5, 2009

(30) Foreign Application Priority Data

Aug. 28, 2007 (JP) ..... 2007-221590

(51) Int. Cl.
*F01P 5/10* (2006.01)

(52) U.S. Cl. ..... 123/41.44

(58) Field of Classification Search ..... 123/196 AB, 123/41.29, 41.33; 165/159, 253, 279, 283, 165/142, 51, 156, 119, 160, 161, 916; 184/104.1, 184/104.3, 6.22; 236/34.5; 65/51
See application file for complete search history.

(56) References Cited

U.S. PATENT DOCUMENTS 2,244,641 A * 6/1941 Fedders ..... 123/196 AB
4,836,276 A * 6/1989 Yamanaka et al. ..... 165/51

FOREIGN PATENT DOCUMENTS

JP 2001-215091 8/2001

* cited by examiner

*Primary Examiner* — Michael Cuff
*Assistant Examiner* — Keith Coleman
(74) *Attorney, Agent, or Firm* — Carrier Blackman & Associates, P.C.; Joseph P. Carrier; William D. Blackman

(57) ABSTRACT

In an oil cooler, a heat exchange core is housed in a casing including a cylindrical sidewall part in a way that a cooling water passage is formed around a heat exchange core. The heat exchange core includes inlet-side and outlet-side oil passages, and enables oil to be delivered from the inlet-side oil passage to the outlet-side oil passage. Inlet and outlet pipes are connected to the sidewall part. The inlet pipe forms a cooling water inlet passage in communication with the cooling water passage. The outlet pipe forms a cooling water outlet passage in communication with the cooling water passage. Outward of the inlet-side oil passage, an outwardly swelling part is formed in the sidewall part of the casing. This arrangement avoids the oil cooler being constructed in a large size and avoids decreasing the heat exchange efficiency of the oil cooler, and also prevents cavitation and erosion from occurring due to the flow of cooling water in an area corresponding to the inlet-side oil passage.

20 Claims, 8 Drawing Sheets

OIL COOLER FOR VEHICLE

CROSS REFERENCE TO RELATED APPLICATIONS

The present invention claims priority under 35 USC §119 based on Japanese patent application No. 2007-221590 filed 28 Aug. 2007. The subject matter of this priority document is incorporated by reference herein.

BACKGROUND OF THE INVENTION

1. Field of the Invention

The present invention relates to an oil cooler for a vehicle, in which a heat exchange core is housed in a casing such that a cooling water passage is formed around the heat exchange core, wherein the casing includes a cylindrical sidewall part, the heat exchange core includes an inlet-side oil passage and an outlet-side oil passage which extend parallel to each other along an axis of the sidewall part, the heat exchange core enables oil to be delivered from the inlet-side oil passage to the outlet-side oil passage, and an inlet pipe and an outlet pipe are connected to the sidewall part, the inlet pipe forming a cooling water inlet passage in communication with the cooling water passage, and the outlet pipe forming a cooling water outlet passage in communication with the cooling water passage.

2. Description of the Related Art

Japanese Patent Application Laid-open No. 2001-215091 has made known the following oil cooler for a vehicle. In the oil cooler, a heat exchange core is housed in a cylindrical casing with first and second plates fastened to its opposite end portions, and the heat exchange core includes an inlet-side oil passage and an outlet-side oil passage which extend parallel to each other along the axis of the casing. An inlet pipe and an outlet pipe are connected to the casing. The inlet pipe forms a cooling water inlet passage, and the outlet pipe forms a cooling water outlet passage.

In the conventional oil cooler as disclosed by Japanese Patent Application Laid-open No. 2001-215091, a spacing between the outer periphery of the heat exchange core and the inner periphery of the casing is narrow, and the flow of cooling water in such a narrow spacing increases the flow rate of the cooling water locally. For this reason, it is likely that cavitation may occur near the inlet-side oil passage where the temperature of the flowing oil is higher than any other part, and that erosion may occur. Measures for preventing such troubles include: enlarging the spacing between the outer periphery of the heat exchange core and the inner periphery of the casing; and arranging the inlet-side oil passage such that it is spaced away from the inner surface of the casing. However, if the spacing is increased, the outer peripheral radius of the heat exchange core has to be decreased, and the heat exchange efficiency accordingly deteriorates. On the other hand, if the inner peripheral radius of the casing is increased, the oil cooler has to be constructed in a larger size. Moreover, if the inlet-side oil passage is arranged spaced away from the inner surface of the casing, the distance between the inlet-side oil passage and the outlet-side oil passage is shortened, and the heat exchange efficiency accordingly deteriorates.

SUMMARY OF THE INVENTION

The present invention has been achieved in view of the above-described circumstances, and it is an object thereof to provide an oil cooler for a vehicle which can be constructed in a relatively small size without decreasing its heat exchange efficiency, as well as concurrently preventing cavitation and erosion from occurring due to the flow of cooling water in an area corresponding to the inlet-side oil passage.

In order to achieve the above object, according to a first aspect and feature of the present invention, there is provided an oil cooler for a vehicle, in which a heat exchange core is housed in a casing such that a cooling water passage is formed around the heat exchange core, wherein the casing includes a cylindrical sidewall part, the heat exchange core includes an inlet-side oil passage and an outlet-side oil passage which extend parallel to each other along an axis of the sidewall part, the heat exchange core enables oil to be delivered from the inlet-side oil passage to the outlet-side oil passage, and an inlet pipe and an outlet pipe are connected to the sidewall part, the inlet pipe forming a cooling water inlet passage in communication with the cooling water passage, and the outlet pipe forming a cooling water outlet passage in communication with the cooling water passage, wherein, outward of the inlet-side oil passage, an outwardly swelling part is formed in the sidewall part of the casing.

With the first aspect and feature, outward of the inlet-side oil passage, the outwardly swelling part is formed in the sidewall part of the casing. For this reason, in a location corresponding to the inlet-side oil passage, the spacing between the inner surface of the sidewall part and the outer periphery of the heat exchange core can be set larger than in a case where the outwardly swelling part would not be formed. Thus, it is possible to increase the cross-sectional area of passage of the cooling water, and accordingly to decrease the flow rate of the cooling water. This makes it unnecessary to set the spacing between the outer periphery of the heat exchange core and the inner periphery of the casing larger throughout the circumference, and also makes it unnecessary to arrange the inlet-side oil passage spaced away from the inner surface of the casing. This makes it possible to avoid the oil cooler being constructed in a large size, and to avoid decreasing the heat exchange efficiency, as well as to concurrently prevent cavitation and erosion from occurring due to the flow of the cooling water in the location corresponding to the inlet-side oil passage.

According to a second aspect and feature of the present invention, in addition to the first aspect and feature, as seen in a plan view projected onto a plane orthogonal to the axis of the sidewall part, the cooling water inlet and outlet passages are distributed to, and arranged on opposite sides of a straight line passing through an axis of the inlet-side oil passage and an axis of the outlet-side oil passage, respectively, and the outwardly swelling part is formed in the sidewall part in a location opposite to the cooling water inlet passage with respect to the inlet-side oil passage.

With the second aspect and feature, as seen in the plan view projected onto the plane orthogonal to the axis of the sidewall part of the casing, the cooling water inlet passage and the cooling water outlet passage are distributed to, and arranged on opposite sides of the straight line passing the axis of the inlet-side oil passage and the axis of the outlet-side oil passage. This arrangement makes it possible to cause the cooling water introduced to the inside of the casing to flow in the casing effectively. Moreover, the outwardly swelling part is formed in the sidewall part of the casing in the location opposite to the cooling water inlet passage with respect to the inlet oil passage. This makes it possible to effectively prevent cavitation from occurring by arranging the outwardly swelling part in an area corresponding to the inlet-side oil passage where the flow of the cooling water coming in from the cooling water inlet passage hits the inner surface of the sidewall part.

According to a third aspect and feature of the present invention, in addition to the first aspect and feature, as seen in a plan view projected onto a plane orthogonal to the axis of the sidewall part, the outwardly swelling part is formed in the sidewall part over an area extending between two points at which a second straight line intersects the sidewall part, the second straight line passing through an axis of the inlet-side oil passage in a manner orthogonal to a first straight line passing through the axis of the sidewall part and the axis of the inlet-side oil passage.

With the third aspect and feature, as seen in the plan view projected onto the plane orthogonal to the axis of the sidewall part of the casing, the outwardly swelling part is formed in the sidewall part over an area extending between two points at which the second straight line intersects the sidewall part. In this respect, the second straight line is that which passes through the axis of the inlet-side oil passage, and which is orthogonal to the first straight line passing through the axis of the sidewall part and the axis of the inlet-side oil passage. This makes it possible to form the outwardly swelling part in the sidewall part over an area in which the cavitation may occur, and thus to avoid forming the outwardly swelling part larger than necessary, as well as accordingly to avoid the casing being constructed in a large size.

According to a fourth aspect and feature of the present invention, in addition to any of the first to third aspects/features, the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

With the fourth aspect and feature, in the invention according to any one of first to third aspects/features, the inlet pipe forming the cooling water inlet passage and the outlet pipe forming the cooling water outlet passage are arranged spaced away from each other in the axial direction of the sidewall part. In addition, the outwardly swelling part is arranged so as to extend, in a direction along the axis of the sidewall part, between the portion where the inlet pipe is connected to the sidewall part and the portion where the outlet pipe is connected to sidewall part. These arrangements make it possible to arrange the outwardly swelling part in an area where the amount of cooling water flow is larger, and accordingly to avoid the outwardly swelling part being formed larger than necessary. This makes it possible to avoid the casing being constructed in a large size.

According to a fifth aspect and feature of the present invention, in addition to any of the first to fourth aspects/features, longitudinal opposite end portions of the outwardly swelling part lengthened in a direction along the axis of the sidewall part have arcuate curve surfaces.

With the fifth aspect and feature, the outwardly swelling part is lengthened in the axial direction of the sidewall part, and the longitudinal opposite end portions of the outwardly swelling part have arcuate curve surfaces. This makes it possible to prevent the cooling water flow from fluctuating around the boundary between the outwardly swelling part and the sidewall part in each of the longitudinal opposite end portions of the outwardly swelling part.

Descriptions will be provided hereinbelow for illustrative embodiments of the present invention on the basis of the examples of the present invention which are shown in the attached drawings.

BRIEF DESCRIPTION OF THE DRAWINGS

FIG. 1 is a longitudinal sectional view of an oil cooler taken along a line 1-1 of FIG. 2.

FIG. 2 is a cross-sectional view of the oil cooler taken along a line 2-2 of FIG. 1.

FIG. 3 is a side view of the oil cooler shown in FIG. 2, viewed in a direction indicated by an arrow 3.

FIG. 4 is a cross-sectional view of the oil cooler taken along a line 4-4 of FIG. 1 with a heat exchange core being illustrated in a simplified manner.

FIG. 5 is a side view of the oil cooler shown in FIG. 2, viewed in a direction indicated by an arrow 5.

DESCRIPTION OF THE PRESENT EMBODIMENTS

Referring to FIGS. 1 to 5, an oil cooler shown therein is used for an engine of a motorcycle for example. The oil cooler includes: a casing 12A attached to an engine case 11; and a heat exchange core 13 housed in the casing 12A.

Figure 1:
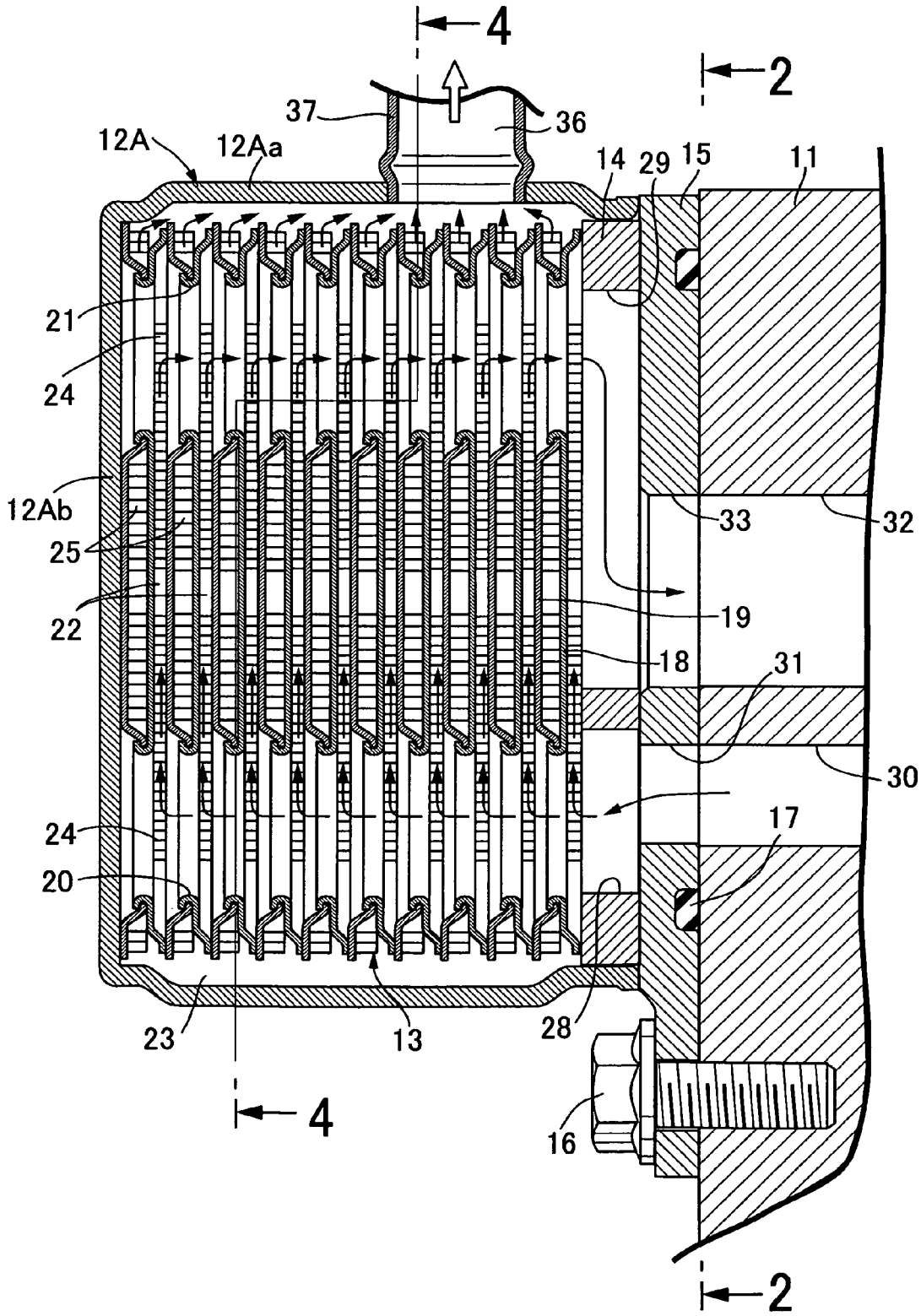
FIGS. 1 to 5 show a first illustrative embodiment of the present invention.
Figure 2:
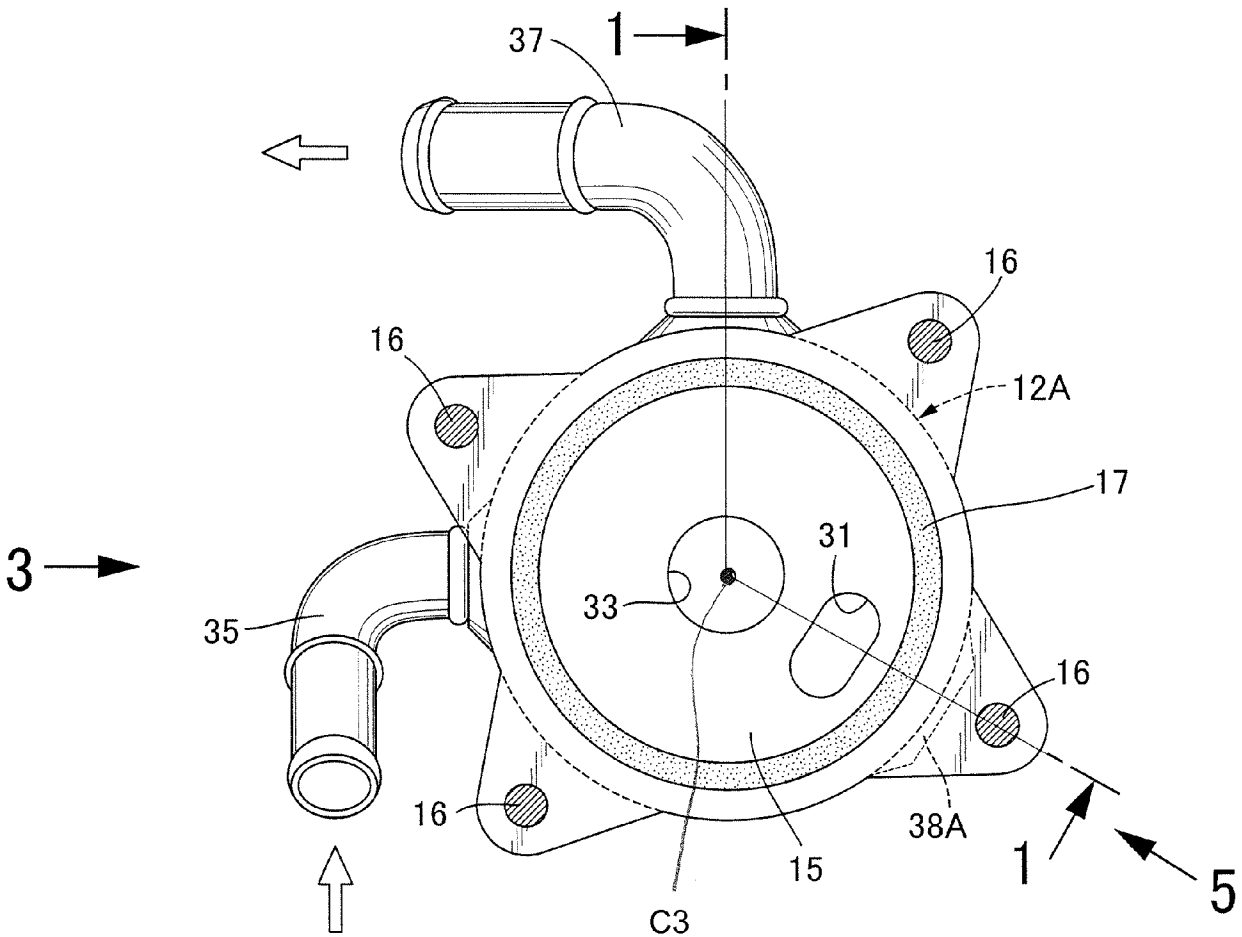
Figure 3:
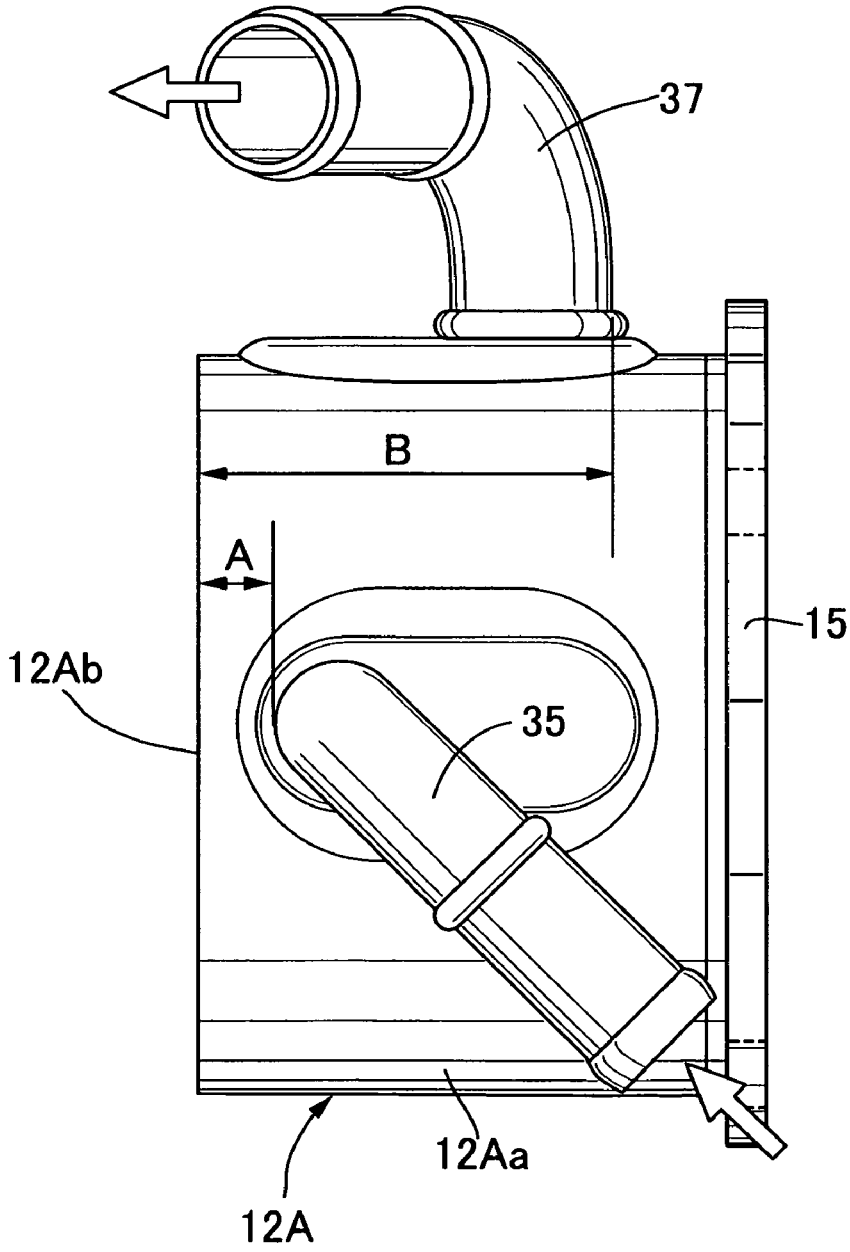
Figure 8:
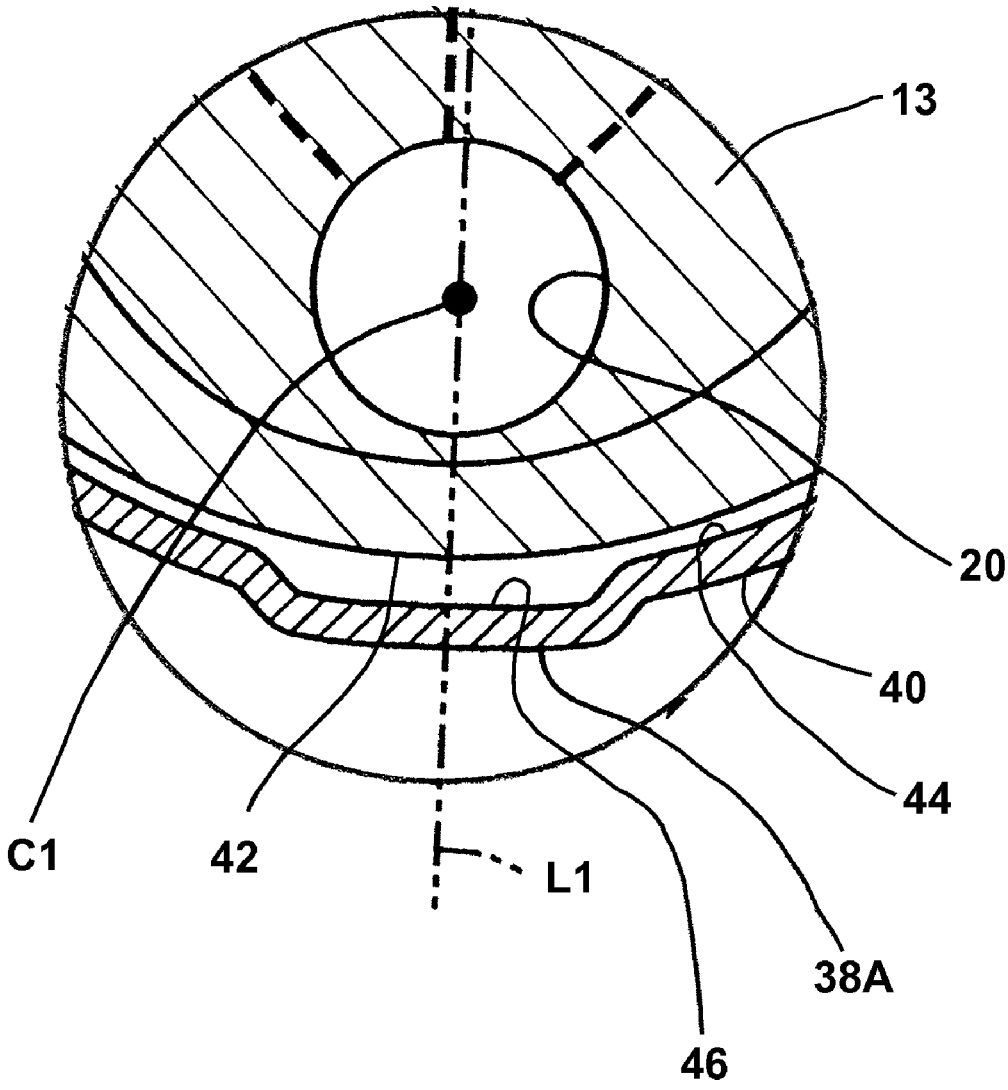
FIG. 8 is an enlarged detail view of a portion of FIG. 4, showing details of the structure in the area of the outwardly swelling part of the cylindrical sidewall.

The casing 12A is of a bottomed cylindrical shape formed by closing one end of a cylindrical sidewall part 12Aa with an end wall part 12Ab, which integrally communicates with the sidewall part 12Aa. As seen in FIG. 8, the cylindrical sidewall part 12Aa includes a first outer case wall portion 40 disposed at a first radial distance from a central axis C3 (see also FIG. 2). The first outer case wall portion 40 is spaced a first distance away from an outer edge portion 42 of the heat exchange core 13, so as to form a first channel portion 44 therebetween having a first depth. Referring now to FIG. 1, it will be seen that an oil chamber plate 14 is fitted into the other end portion of the sidewall part 12Aa, opposite the end wall part 12Ab. In addition, an attachment plate 15 is provided adjacent to, and fixed to the other end of the sidewall part 12Aa. The attachment plate 15 abuts the oil chamber plate 14. This attachment plate 15 is fastened to the engine case 11 with multiple fasteners, for example, with four bolts 16. An annular sealing member 17 is placed between the engine case 11 and the attachment plate 15.

Figure 4:
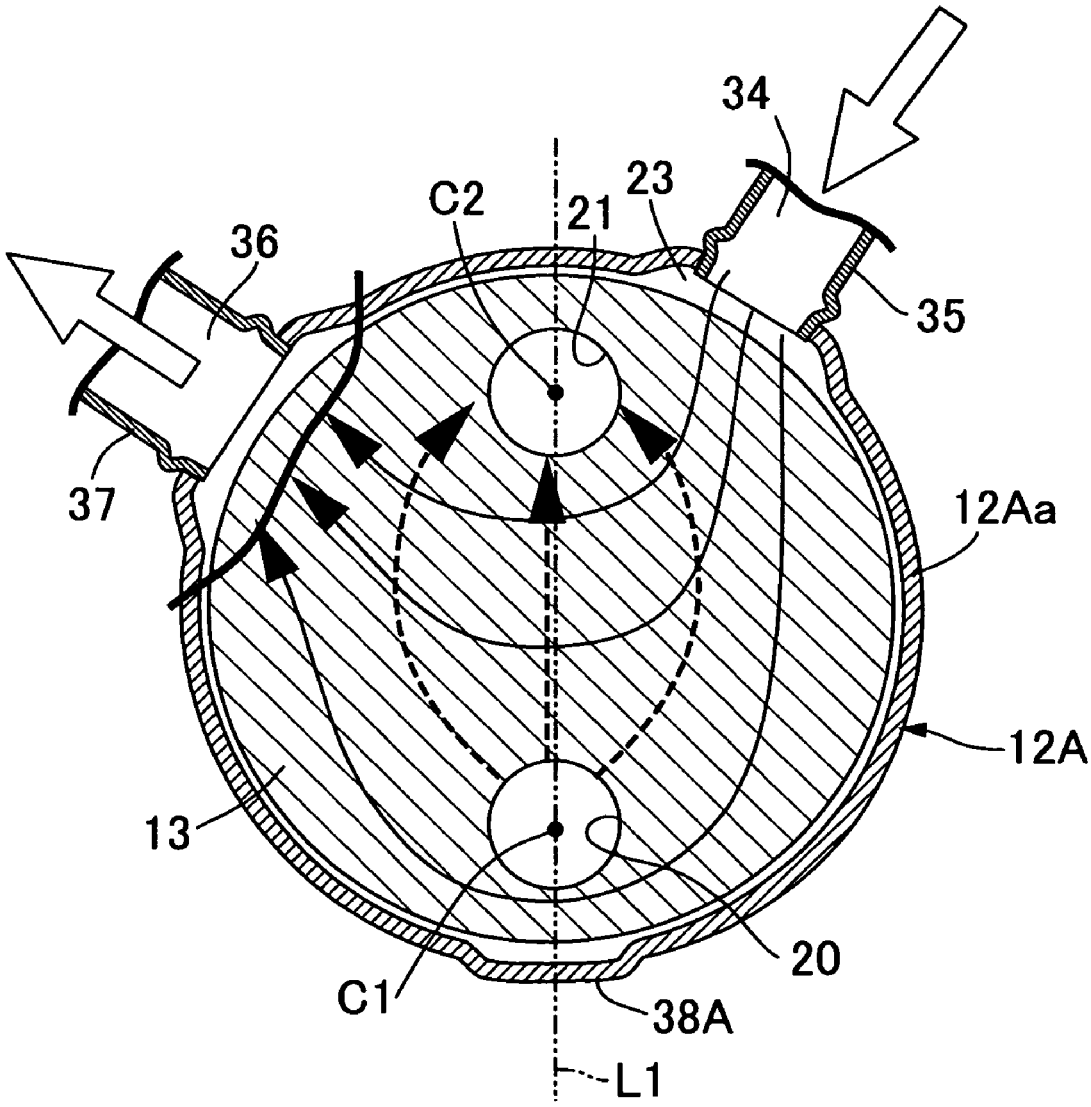

The heat exchange core 13 is formed by laying a plurality of layers of first and second core plates 18 and 19 one on another in an axial direction of sidewall part 12Aa of the casing 12A, in which the first core plate 18 and the second core plate 19 in each layer are connected together by press-molding so as to have predetermined concave and convex shapes. This heat exchange core 13 is held between the end wall part 12Ab and the oil chamber plate 14. The outer edge portion 42 of the heat exchange core 13 has a substantially circular outline shape in plan view, as shown in FIG. 4. Moreover, the heat exchange core 13 includes: an inlet-side oil passage 20 and an outlet-side oil passage 21 which both extend in parallel to each other and substantially parallel to a central axis C3 of the casing 12A. The heat exchange core 13 also has multiple exchange passages 22 formed therein, as shown, for exchanging oil from the inlet-side oil passage 20 to the outlet-side oil passage 21. This heat exchange core 13 is housed in the casing 12A. Additionally, as shown in FIG. 4, the axis C1 of the inlet-side oil passage 20 and the axis C2 of the outlet-side oil passage 21 are arranged on a straight line L1 passing through the central axis C3 of the sidewall part 12Aa as seen in a plan view projected onto a plane orthogonal to the axis of the sidewall part 12Aa.

In the casing 12Aa, a cooling water passage 23 is formed around the heat exchange core 13. The heat exchange core 13 is provided with multiple inner fins 24 each facing the inlet-side oil passage 20, the exchange passage 22, and the outlet-side oil passage 21. The heat exchange core 13 is provided with multiple inner fins 25, each facing the cooling water passage 23.

In addition, the oil chamber plate 14 comprises: an inlet hole 28 communicating with the inlet-side oil passage 20; and an outlet hole 29 communicating with the outlet-side oil passage 21. The attachment plate 15 comprises: an inlet-side communication hole 31 through which a first oil passage 30 provided to the engine case 11 communicates with the inlet hole 28; and an outlet-side communication hole 33 through which a second oil passage 32 provided to the engine case 11 communicates with the outlet hole 29.

Referring also to FIG. 4, an inlet pipe 35 and an outlet pipe 37 are connected to the sidewall part 12Aa of the casing 12A. The inlet pipe 35 forms a cooling water inlet passage 34 communicating with the cooling water passage 23. The outlet pipe 37 forms a cooling water outlet passage 36 communicating with the cooling water passage 23. As seen in a plan view projected onto a plane orthogonal to the axis of the sidewall part 12Aa, the cooling water inlet passage 34 and the cooling water outlet passage 36 are distributed to, and arranged on opposite sides of the line L1 passing through the axis C1 of the inlet-side oil passage 20 and the axis C2 of the outlet-side oil passage 21. In addition, as clearly shown in FIG. 3, the inlet pipe 35 and the outlet pipe 37 are connected to the sidewall part 12Aa in a way that the inlet pipe 35 and the outlet pipe 37 are spaced away from each other in the axial direction of the sidewall part 12Aa. The outlet pipe 37 is arranged closer to the attachment plate 15 than the inlet pipe 35.

Outward of the inlet-side oil passage 20, an outwardly swelling part 38A is formed in the sidewall part 12Aa of the casing 12A. Referring again to FIG. 8, it will be seen that the outwardly swelling part 38A extends radially outwardly beyond the first outer case wall portion 40 so as to be disposed a second radial distance from the central axis C3, which is greater than the first radial distance at which the first outer case wall portion is situated. The outwardly swelling part 38A is also spaced a second distance away from the outer edge portion 42 of the heat exchange core 13 so as to form a second channel portion 46 therebetween having a second depth which is greater than the first depth, whereby the size of the cooling water passage 23 is increased in the outwardly swelling part.

Figure 5:
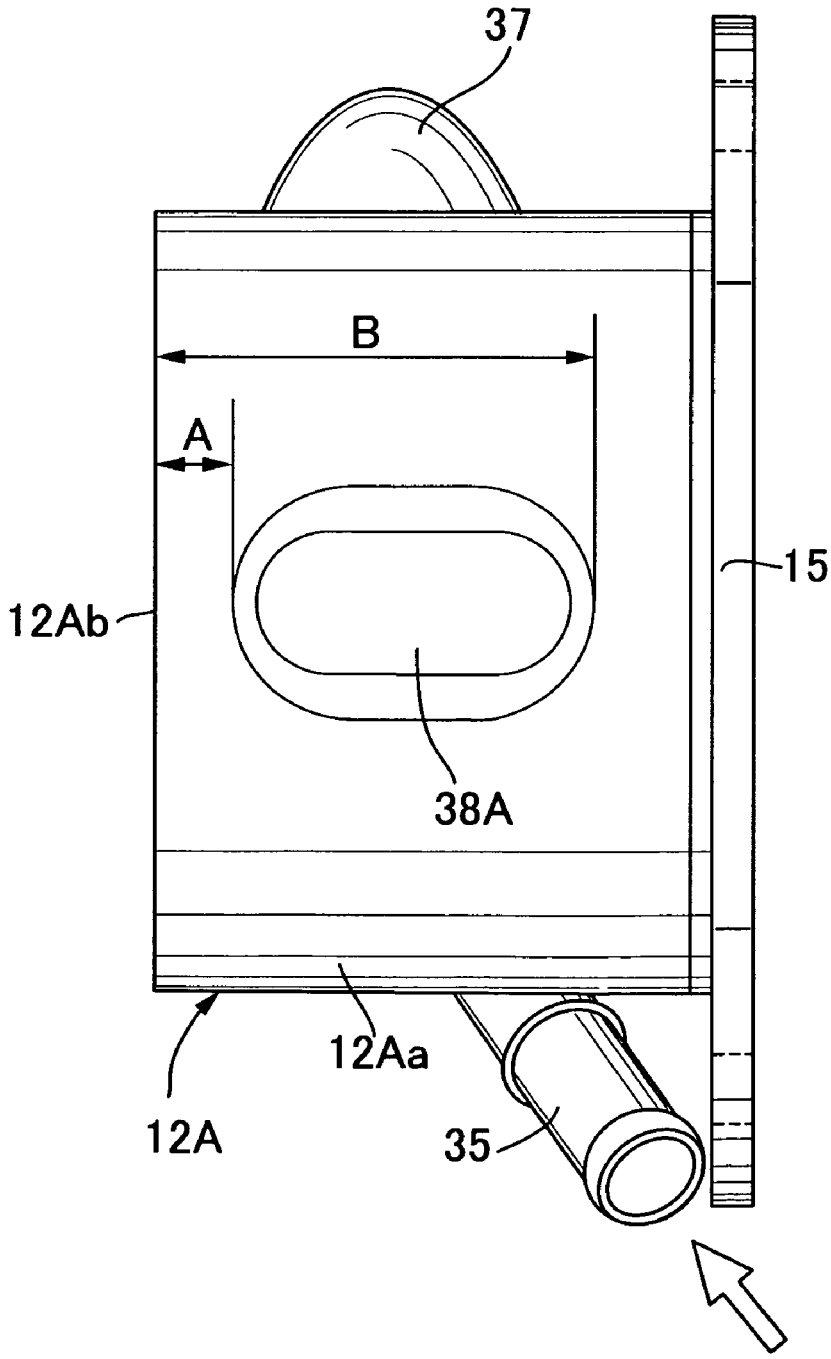

Further, the outwardly swelling part 38A is arranged in the axial direction of the sidewall part 12Aa so as to extend between a portion where the inlet pipe 35 is connected to the sidewall part 12Aa and a portion where the outlet pipe 37 is connected to the sidewall part 12Aa. Specifically, as shown in FIG. 5, the outwardly swelling part 38A is elongated in the axial direction of the sidewall part 12Aa. One end of the outwardly swelling part 38A is situated in a location whose distance from the one end of the casing 12A is substantially equal to A, defined as the distance from the one end of the casing 12A to the portion where the inlet pipe 35 is connected to the sidewall part 12Aa. The other end of the outwardly swelling part 38A is situated in a location whose distance from the other end of the casing 12A is substantially equal to B, defined as the distance from the one end of the casing 12A to the portion where the outlet pipe 37 is connected to the sidewall part 12Aa. The longitudinal opposite end portions of the outwardly swelling part 38A have arcuate curve surfaces.

Next, descriptions will be provided on the operation of the present invention according to a first illustrative embodiment. The outwardly swelling part 38A is formed in the sidewall part 12Aa of the casing 12A outward of the inlet-side oil passage 20. For this reason, in a location corresponding to the inlet-side oil passage 20, the interval between the inner surface of the sidewall part 12Aa of the casing 12A and the outer periphery of the heat exchange core 13 can be set larger than in a case where the outwardly swelling part 38A would not be formed. Thus, it is possible to increase the cross-section area of passage of the cooling water, and accordingly to decrease the flow rate of the cooling water. This makes it unnecessary that the interval between the outer periphery of the heat exchange core 13 and the inner periphery of the casing 12A should be set larger throughout the circumference, and that the inlet-side oil passage 20 should be arranged spaced away from the inner surface of the casing 12A. This makes it possible to avoid the oil cooler being constructed in a large size, and to avoid decreasing the heat exchange efficiency, as well as concurrently to prevent cavitation and erosion from occurring due to the flow of the cooling water in the area corresponding to the inlet-side oil passage 20.

In addition, in a plan view projected onto the plane orthogonal to the axis of the sidewall part 12Aa of the casing 12A, the cooling water inlet passage 34 and the cooling water outlet passage 36 are distributed to, and arranged on opposite sides of the straight line L1 passing through the axis C1 of the inlet-side oil passage 20 and the axis C2 of the outlet-side oil passage 21. This arrangement makes it possible to cause the cooling water introduced to the inside of the casing 12A to flow in the casing 12A more effectively than in an arrangement in which both the cooling water inlet passage 34 and the cooling water outlet passage 36 would be arranged in one of the two sides of the straight line L1.

Furthermore, the inlet pipe 35 forming the cooling water inlet passage 34 and the outlet pipe 37 forming the cooling water outlet passage 36 are arranged spaced away from each other in the axial direction of the sidewall part 12Aa. In addition, the outwardly swelling part 38A is arranged in the axial direction of the sidewall part 12Aa so as to extend between the portion where the inlet pipe 35 is connected to the sidewall part 12Aa and the portion where the outlet pipe 37 is connected to the sidewall part 12Aa. These arrangements make it possible to arrange the outwardly swelling part 38A in an area where the amount of cooling water flow is larger, and accordingly to avoid the outwardly swelling part 38A being formed larger than necessary. This makes it possible to avoid the casing 12A being constructed in a large size.

Moreover, the outwardly swelling part 38A is formed so as to be longer in the axial direction of the sidewall part 12Aa, and the longitudinal opposite end portions of the outwardly swelling part 38A have arcuate curve surfaces. This makes it possible to prevent the cooling water flow from fluctuating around the boundary between the outwardly swelling part 38A and the sidewall part 12Aa in each of the longitudinal opposite end portions of the outwardly swelling part 38A.

Figure 6:
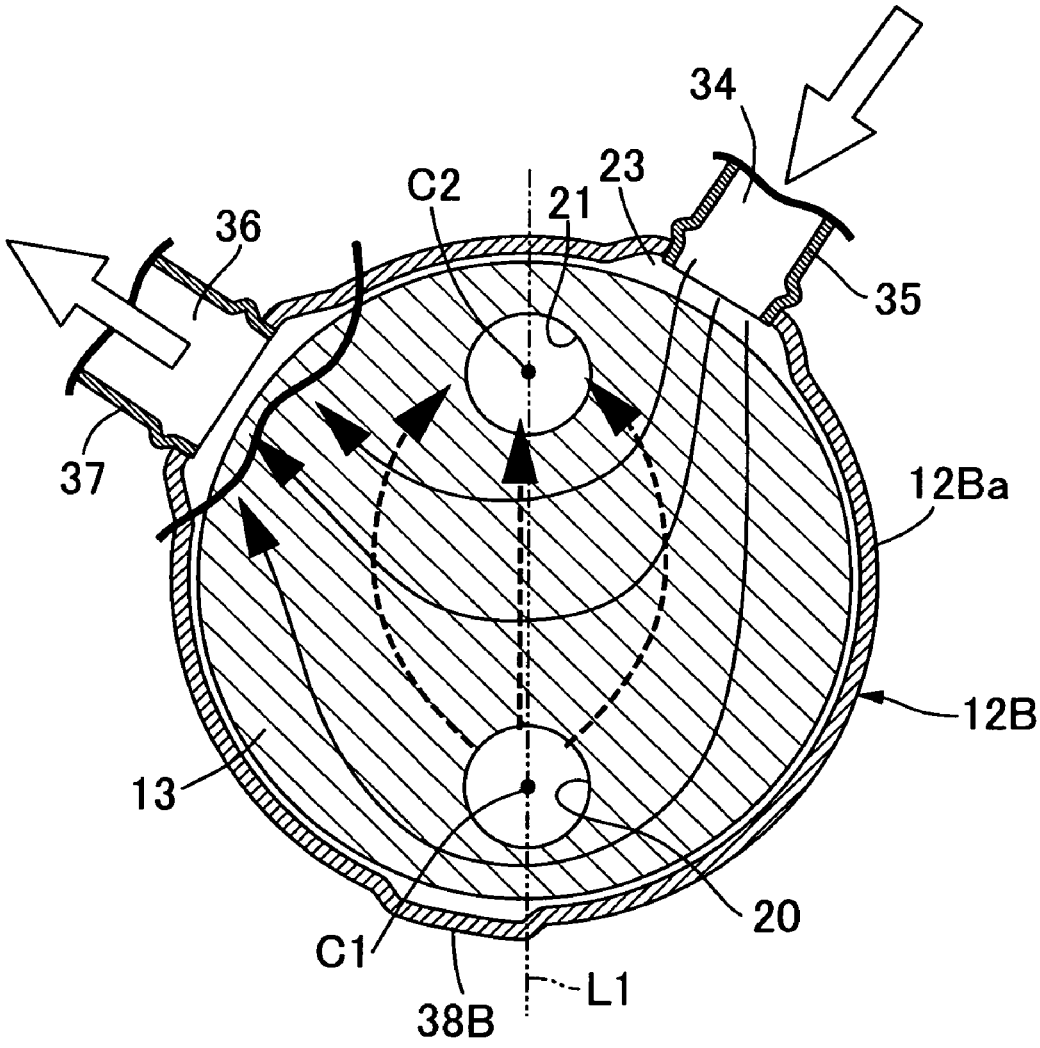
FIG. 6 is a cross-sectional view of an oil cooler according to a second illustrative embodiment of the present invention.

FIG. 6 shows the present invention according to a second illustrative embodiment. Components corresponding to those of the first illustrative embodiment are denoted by the same reference numerals, and are illustrated only. Detailed descriptions will be omitted for these components.

The inlet pipe 35 forming the cooling water inlet passage 34 communicating with the cooling water passage 23 and the outlet pipe 37 forming the cooling water outlet passage 36 communicating with the cooling water passage 23 are connected to a sidewall part 12Ba of a casing 12B in a way that, like in the case of the first illustrative embodiment, the inlet pipe 35 and the outlet pipe 37 are distributed to, and arranged on opposite sides of the straight line L1 passing through the axis C1 of the inlet-side oil passage 20 and the axis C2 of the outlet-side oil passage 21 as seen in the plan view projected onto the plane orthogonal to the axis of the sidewall part 12Ba. The outwardly swelling part 38B is formed in the sidewall part 12Ba of the casing 12B in a location opposite to the cooling water inlet passage 34 with respect to the inlet-side oil passage 20.

According to the second illustrative embodiment, the outwardly swelling part 38B is formed in the sidewall part 12Ba of the casing 12B in the location opposite to the cooling water inlet passage 34 with respect to the inlet oil passage 20. This arrangement makes it possible to effectively prevent cavitation from occurring by arranging the outwardly swelling part 38B in an area corresponding to the inlet-side oil passage 20 where the flow of the cooling water coming in from the cooling water inlet passage 34 hits the inner surface of the sidewall part 12 B.

Figure 7:
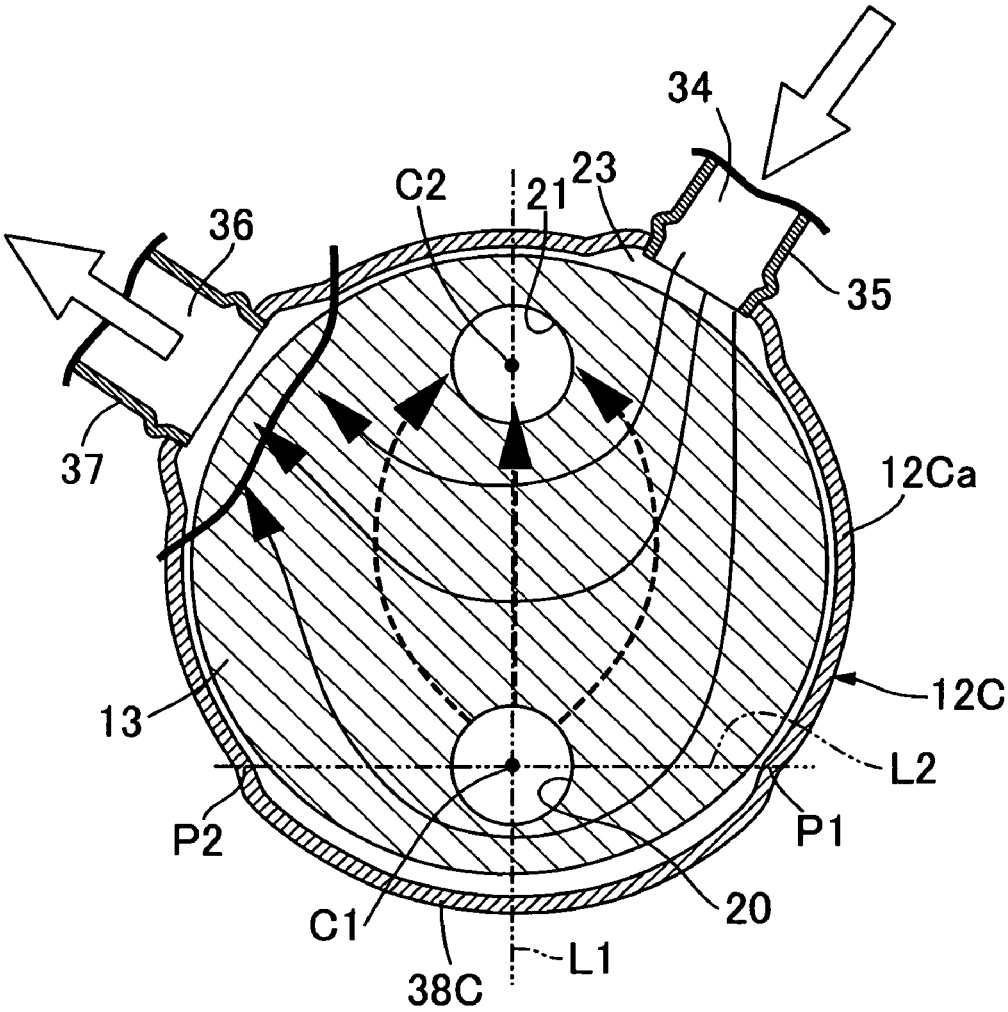
FIG. 7 is a cross-sectional view of an oil cooler according to a third illustrative embodiment of the present invention.

FIG. 7 shows the present invention according to a third illustrative embodiment. Components corresponding to those of the first and second illustrative embodiments are denoted by the same reference numerals, and are illustrated only. Detailed descriptions will be omitted for these components.

As seen in the plan view projected onto the plane orthogonal to the axis of the sidewall part 12Ca of the casing 12C, an outwardly swelling part 38C is formed in the sidewall part 12Ca over an area extending between points P1 and P2 at which a second straight line L2 intersects the sidewall part 12Ca. Here, the second straight line L2 passes through the axis C1 of the inlet-side oil passage 20, and is orthogonal to a first straight line L1 passing through the axis of the sidewall part 12Ca and the axis C1 of the inlet-side oil passage 20.

The third illustrative embodiment makes it possible to form the outwardly swelling part 38C in the sidewall part 12Ca over an area in which the cavitation may occur, and thus to avoid forming the outwardly swelling part 38C larger than necessary, as well as accordingly to avoid the casing 12 being constructed in a large size.

The foregoing descriptions have been provided for the illustrative embodiments of the present invention. However, the present invention is not limited to the above-described embodiments. Various design modifications may be made without departing from the spirit or scope of the present invention as set forth in the appended claims.

What is claimed is:

1. An oil cooler for a vehicle, comprising:

a casing having a substantially cylindrical sidewall part with a central axis and comprising a first outer case wall portion disposed at a first radial distance from the central axis;

a heat exchange core housed in the casing such that a cooling water passage is formed around the heat exchange core, the heat exchange core having an inlet-side oil passage and an outlet-side oil passage formed therein which extend parallel to each other and substantially parallel to the central axis of the sidewall part, and the heat exchange core enables oil to be delivered from the inlet-side oil passage to the outlet-side oil passage, wherein the first outer case wall portion is spaced a first distance away from an outer edge portion of the heat exchange core so as to form a first channel portion therebetween having a first depth; and an inlet pipe and an outlet pipe which are connected to the sidewall part, the inlet pipe forming a cooling water inlet passage communicating with the cooling water passage, and the outlet pipe forming a cooling water outlet passage communicating with the cooling water passage, wherein, outward of the inlet-side oil passage, an outwardly swelling part is formed in the sidewall part of the casing, the outwardly swelling part extending outwardly beyond the first outer case wall portion so as to be disposed a second radial distance from the central axis which is greater than the first radial distance, the outwardly swelling part also spaced a second distance away from the outer edge portion of the heat exchange core so as to form a second channel portion therebetween having a second depth which is greater than the first depth, whereby the size of the cooling water passage is increased in the outwardly swelling part.

2. The oil cooler for a vehicle according to claim 1, wherein as seen in a plan view projected onto a plane orthogonal to the axis of the sidewall part, the cooling water inlet passage and the cooling water outlet passage are distributed to, and arranged on opposite sides of a straight line passing through an axis of the inlet-side oil passage and an axis of the outlet-side oil passage and the outwardly swelling part is formed in the sidewall part in a location opposite to the cooling water inlet passage with respect to the inlet-side oil passage.

3. The oil cooler for a vehicle according to claim 1, wherein as seen in a plan view projected onto a plane orthogonal to the axis of the sidewall part, the outwardly swelling part is formed in the sidewall part over an area extending between two points at which a second straight line intersects the sidewall part, the second straight line passing through an axis of the inlet-side oil passage in a manner orthogonal to a first straight line passing through the axis of the sidewall part and the axis of the inlet-side oil passage.

4. The oil cooler for a vehicle according to claim 1, wherein the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

5. The oil cooler for a vehicle according to claim 2, wherein the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

6. The oil cooler for a vehicle according to claim 3, wherein the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

7. The oil cooler for a vehicle according to claim 1, wherein longitudinal opposite end portions of the outwardly swelling part lengthened in a direction along the axis of the sidewall part have arcuate curved surfaces.

8. The oil cooler for a vehicle according to claim 2, wherein longitudinal opposite end portions of the outwardly swelling part lengthened in a direction along the axis of the sidewall part have arcuate curved surfaces.

9. The oil cooler for a vehicle according to claim 3, wherein longitudinal opposite end portions of the outwardly swelling part lengthened in a direction along the axis of the sidewall part have arcuate curved surfaces.

10. The oil cooler for a vehicle according to claim 4, wherein longitudinal opposite end portions of the outwardly swelling part lengthened in a direction along the axis of the sidewall part have arcuate curved surfaces.

11. The oil cooler for a vehicle according to claim 5, wherein longitudinal opposite end portions of the outwardly swelling part lengthened in a direction along the axis of the sidewall part have arcuate curved surfaces.

12. The oil cooler for a vehicle according to claim 6, wherein longitudinal opposite end portions of the outwardly swelling part lengthened in a direction along the axis of the sidewall part have arcuate curved surfaces.

13. An oil cooler for a vehicle, comprising:

a casing having a cylindrical sidewall part with a central axis and comprising a first outer case wall portion disposed at a first radial distance from the central axis;

a heat exchange core housed in the casing such that a cooling water passage is defined around the core within the sidewall part;

wherein the heat exchange core has inlet-side and outlet-side oil passages formed therein which extend parallel to each other and to the central axis of the sidewall part, and the core enables oil to flow from the inlet-side oil passage to the outlet-side passage, wherein the first outer case wall portion is spaced a first distance away from an outer edge portion of the heat exchange core so as to form a first channel portion therebetween having a first depth;

coolant inlet and outlet pipes connected to the casing sidewall part and forming cooling water inlet and outlet passages, respectively, which communicate with the cooling water passage; and wherein an outwardly swelling part is formed in the casing sidewall part outwardly of the inlet-side oil passage, the outwardly swelling part extending outwardly beyond the first outer case wall portion so as to be disposed a second radial distance from the central axis which is greater than the first radial distance, the outwardly swelling part also spaced a second distance away from the outer edge portion of the heat exchange core so as to form a second channel portion therebetween having a second depth which is greater than the first depth, whereby the size of the water passage is increased in the outwardly swelling part.

14. The oil cooler for a vehicle according to claim 13, wherein the casing is of a cylindrical shape having one end closed and which is adapted to be attached to an engine.

15. The oil cooler for a vehicle according to claim 14, wherein as seen in a plan view projected onto a plane orthogonal to the axis of the sidewall part, the cooling water inlet passage and the cooling water outlet passage are distributed to, and arranged on opposite of a straight line passing through an axis of the inlet-side oil passage and an axis of the outlet-side oil passage and the outwardly swelling part is formed in the sidewall part in a location opposite to the cooling water inlet passage with respect to the inlet-side oil passage.

16. The oil cooler for a vehicle according to claim 14, wherein as seen in a plan view projected onto a plane orthogonal to the axis of the sidewall part, the outwardly swelling part is formed in the sidewall part over an area extending between two points at which a second straight line intersects the sidewall part, the second straight line passing through an axis of the inlet-side oil passage in a manner orthogonal to a first straight line passing through the axis of the sidewall part and the axis of the inlet-side oil passage.

17. The oil cooler for a vehicle according to claim 15, wherein the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

18. The oil cooler for a vehicle according to claim 16, wherein the inlet pipe and the outlet pipe are connected to the sidewall part in such a way as to be spaced away from each other in a direction along the axis of the sidewall part, and the outwardly swelling part is arranged so as to extend, in a direction along the axis of the sidewall part, between a portion where the inlet pipe is connected to the sidewall part and a portion where the outlet pipe is connected to the sidewall part.

19. The oil cooler for a vehicle according to claim 17, wherein longitudinal opposite end portions of the outwardly swelling part lengthened in a direction along the axis of the sidewall part have arcuate curved surfaces.

20. The oil cooler for a vehicle according to claim 18, wherein longitudinal opposite end portions of the outwardly swelling part lengthened in a direction along the axis of the sidewall part have arcuate curved surfaces.

* * * * *